US006789321B2

(12) United States Patent
Simms

(10) Patent No.: US 6,789,321 B2
(45) Date of Patent: Sep. 14, 2004

(54) RAZORS

(75) Inventor: Graham John Simms, Tokers Green (GB)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 09/919,992

(22) Filed: Aug. 2, 2001

(65) Prior Publication Data

US 2002/0023351 A1 Feb. 28, 2002

Related U.S. Application Data

(63) Continuation of application No. PCT/GB00/00480, filed on Feb. 14, 2000.

(30) Foreign Application Priority Data

Feb. 15, 2001 (GB) ..... 9903415

(51) Int. Cl.[7] ..... B26B 21/00; B26B 21/44; B26B 21/52

(52) U.S. Cl. ..... 30/41; 30/535; 30/538

(58) Field of Search ..... 30/41, 535, 538, 30/541

(56) References Cited

U.S. PATENT DOCUMENTS

| | | | | | |
|---|---|---|---|---|---|
| 2,327,192 | A | * | 8/1943 | Keene | 30/41 |
| 2,866,265 | A | * | 12/1958 | Kells | 30/41 |
| 3,139,683 | A | * | 7/1964 | Waldman | 30/41 |
| 3,343,201 | A | * | 9/1967 | Cox et al. | 401/190 |
| 3,417,468 | A | * | 12/1968 | Miyauchi | 30/41 |
| 3,726,009 | A | | 4/1973 | Hackmyer | |
| 3,915,345 | A | * | 10/1975 | Harrison et al. | 222/136 |
| 4,023,269 | A | * | 5/1977 | Lopez, Jr. | 30/41 |
| 4,077,119 | A | | 3/1978 | Sellera | |
| 4,433,483 | A | * | 2/1984 | Lazarus | 30/41 |
| 4,625,402 | A | * | 12/1986 | Kavoussi | 30/41 |
| 4,809,432 | A | | 3/1989 | Schauble | |
| 4,881,323 | A | * | 11/1989 | McGaughan | 30/41 |
| 4,908,945 | A | * | 3/1990 | Jacobson | 30/41 |
| 5,016,351 | A | * | 5/1991 | Drahus | 30/41 |
| 5,070,611 | A | * | 12/1991 | Derin et al. | 30/41 |
| RE33,860 | E | * | 3/1992 | Chen | 30/41 |
| 5,103,560 | A | * | 4/1992 | Podolsky | 30/41 |
| 5,113,585 | A | * | 5/1992 | Rogers et al. | 30/41 |
| 5,133,130 | A | * | 7/1992 | Podolsky | 30/41 |
| 5,141,349 | A | | 8/1992 | Maguire et al. | |
| 5,249,361 | A | * | 10/1993 | Apprille et al. | 30/77 |
| 5,337,478 | A | * | 8/1994 | Cohen et al. | 30/41 |
| 5,560,106 | A | * | 10/1996 | Armbruster et al. | 30/527 |
| 5,564,190 | A | * | 10/1996 | Fleetwood | 30/41 |
| 5,655,302 | A | * | 8/1997 | Mroczka | 30/41 |
| 5,701,674 | A | * | 12/1997 | Mitchell | 30/41 |
| 5,761,813 | A | * | 6/1998 | Frick et al. | 30/41 |
| 5,787,586 | A | * | 8/1998 | Apprille et al. | 30/47 |
| 6,349,471 | B1 | * | 2/2002 | Gruslin et al. | 30/50 |
| 6,473,970 | B1 | * | 11/2002 | Prochaska | 30/41 |

FOREIGN PATENT DOCUMENTS

| | | |
|---|---|---|
| GB | 2266854 A | 11/1993 |
| WO | WO 88/06511 A1 | 9/1988 |
| WO | WO 93/10947 A1 | 6/1993 |
| WO | WO 97/37819 A3 | 10/1997 |
| WO | WO 97/37819 A2 | 10/1997 |

* cited by examiner

*Primary Examiner*—Allan N. Shoap
*Assistant Examiner*—Jason Prone
(74) *Attorney, Agent, or Firm*—Charles P. Boukus, Jr.; Donal B. Tobin

(57) ABSTRACT

In a safety razor a blade unit (1) is mounted on a carrying structure (2) for pivotal movement, and a delivery system (25,32,44) for conducting from a reservoir (21) a fluid, e.g. a lubricating fluid, which is to be applied to the skin during shaving, discharges the fluid at a port (45) which opens at or close to the pivot axis. The delivery system incorporates a valve (22,24) to control the supply of fluid to the blade unit (1) and the blade unit carrying structure (2) is coupled to the valve for the valve to eb actuated in response to the blade unit (1) being pressed against the skin during shaving. The blade unit carrying structured (2) is connected to a support structure (35) by a hinged coupling (36) and the valve is operated by a hinged movement of the blade unit carrying structure (2).

24 Claims, 8 Drawing Sheets

RAZORS

This is a continuation of International Application No. PCT/GB00/00480 with an international filing date of Feb. 14, 2000.

BACKGROUND OF THE INVENTION

This invention relates to the field of shaving and, more especially, to so-called "wet shaving" in the process of which a razor with one or more sharpened cutting edges is moved over the skin to sever hairs projecting from the skin. In association with wet shaving it is usual to apply to the skin a preparation, such as shaving soap, which can be applied by means of a brush, shaving foam, or shaving gel to improve the conditions for actual shaving. The need to prepare the skin in this way as part of the overall shaving procedure is an inconvenience and adds significantly to the time required to complete a satisfactory shave. It is also desirable sometimes to apply fluids of other kinds to the skin when shaving.

There have been many proposals for razors which include a system for conveying a shaving preparation, e.g. a lubricating fluid, from a reservoir incorporated in the razor structure, such as an aerosol container which serves as the razor handle, to a dispensing location near the head of the razor. However, as far as known to the Applicant none of these prior proposals have been found to be commercially acceptable. Many modern safety razors have blade units which are movably mounted, in particular pivotable, relative to the handle structures on which they are mounted either permanently, in the case of disposable safety razors intended to be discarded when the blade or blades have become dulled, or detachably to allow replacement of the blade unit on a reusable handle structure. The lubricant fluid delivery systems proposed according to the prior art are not ideally suited to such razors. In addition they are generally awkward to use and demand a degree of dexterity on the part of the user who typically is required to press a button to open a valve for fluid to be discharged from the reservoir for delivery to the razor head.

Some examples of previously proposed razors with fluid delivery systems are those described in U.S. Pat. Nos. 4,077,119, 4,809,432, 5,141,349, GB-A-2266854 and WO-A-88/06511.

BRIEF SUMMARY OF THE INVENTION

The present invention addresses the limitations of the prior art and in accordance with one aspect provides a razor comprising a blade unit carrying structure on which a blade unit is mounted or mountable for pivotal movement about a predetermined axis during shaving, and a delivery system for conducting a fluid dispensed from a reservoir connected to the blade unit carrying structure to at least one discharge port, wherein the discharge port opening is at or close to the predetermined pivot axis.

By arranging the fluid to be discharged through a port located on or very near the pivot axis of the blade unit, the discharge can occur essentially at the same location, preferably at a guard surface in front of the blade or blades, irrespective of the pivotal movements of the blade unit, and this advantageous result can be achieved with the discharge port being defined by a part which remains stationary with the blade unit carrying structure. In addition, a direct mechanical connection between the stationary part, which may conveniently be constituted by a delivery tube, and the blade unit is not needed, which can simplify blade unit replacement when the razor is intended for use with replaceable blade units.

The blade unit is preferably provided with a channel, which can be open continuously along the length thereof, for distributing fluid delivered through the discharge port across the blade unit in the direction of the pivot axis. The channel can be at least partly defined by an elastomeric skin contacting element having a lip which surrounds and seals against the delivery tube adjacent the discharge port.

In accordance with another aspect the invention resides in a razor comprising a blade unit carrying structure on one end of which a blade unit is mounted or mountable for pivotal movement relative to the carrying structure, an opposite end of the blade unit carrying structure being hingedly connected to a supporting structure, a delivery system for conducting a fluid to the blade unit from a reservoir, the delivery system including a valve for controlling supply of fluid to the blade unit, the blade unit carrying structure being coupled to the valve for the valve to be actuated by displacement of the blade unit carrying structure relative to the supporting structure caused by pressing the blade unit against the skin during shaving, and the blade unit carrying structure being resiliently biased to close the valve when the blade unit is lifted clear of the skin.

A preferred razor according to the invention embodies both aspects described above. By the valve being actuated by movement of the blade unit carrying structure brought about by pressing the blade unit against the skin it can be ensured that fluid is delivered precisely when and where it is needed or desired, such as immediately in front of the blade(s) of the blade unit, and the user is not required to perform any additional operation in order to open the control valve. Nonetheless, the blade unit carrying structure can be adapted also to allow direct manual operation of the control valve by the user to provide for greater flexibility in use. The blade unit carrying structure is conveniently movably connected to a supporting structure, more especially integrally hingedly coupled to the supporting structure by one or more flexible webs. The reservoir is preferably constituted by a container to which the supporting structure, conveniently having the form of a ring, is attached, for example by friction or a snap-fit connection with a rim of the container. The blade unit carrying structure may comprise a hollow stem extending upwardly from a flange-like base which is connected to the supporting ring by a pair of laterally opposed web hinges and the base can define a finger button at which the base can be engaged and be depressed by a finger of the user to open the valve.

In conformity with the foregoing the invention also provides a razor or razor blade unit carrying structure wherein the blade unit carrying structure and the supporting structure are integrally connected by at least one flexible web.

The invention described herein is applicable, in its various novel aspects, to razors intended for shaving the face as well to razors, e.g. as commonly used by women, for shaving other areas of the body such as the legs.

BRIEF DESCRIPTION OF THE DRAWINGS

A complete understanding of the invention will be gained from the more detailed description which follows and in which reference is made to the accompanying drawings, wherein.

DETAILED DESCRIPTION OF THE INVENTION

Figure 1:
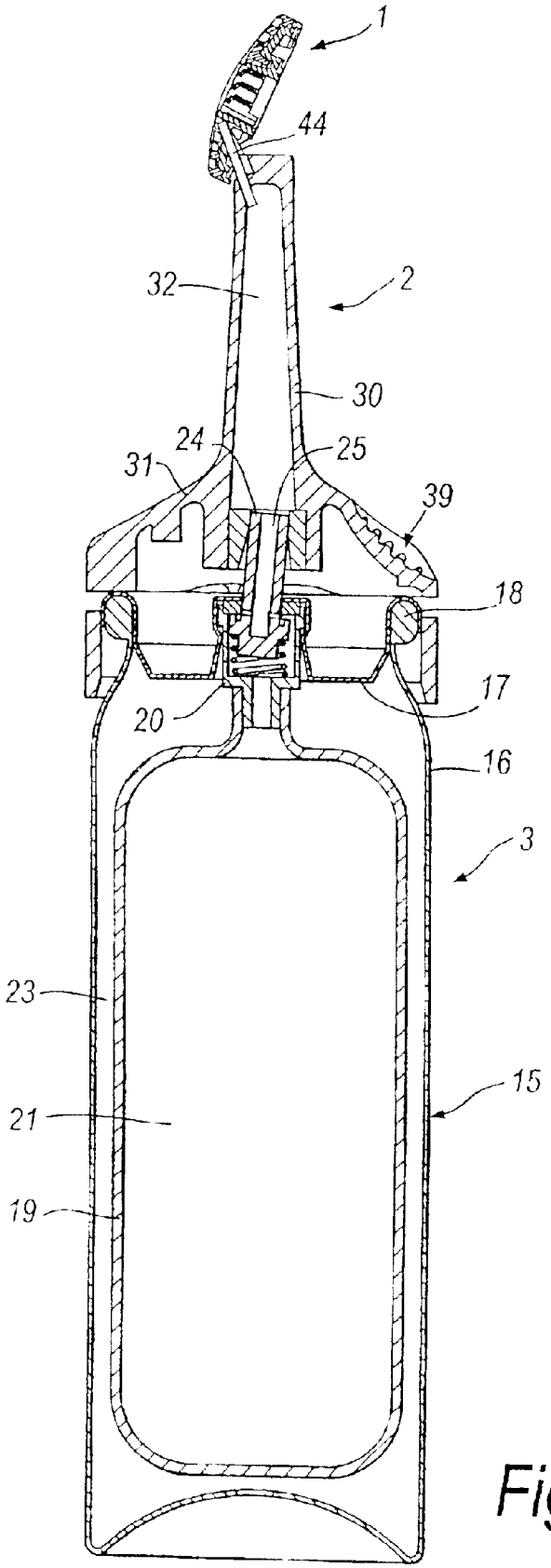
FIG. 1 is an axial cross section through a safety razor embodying the invention.
Figure 2:
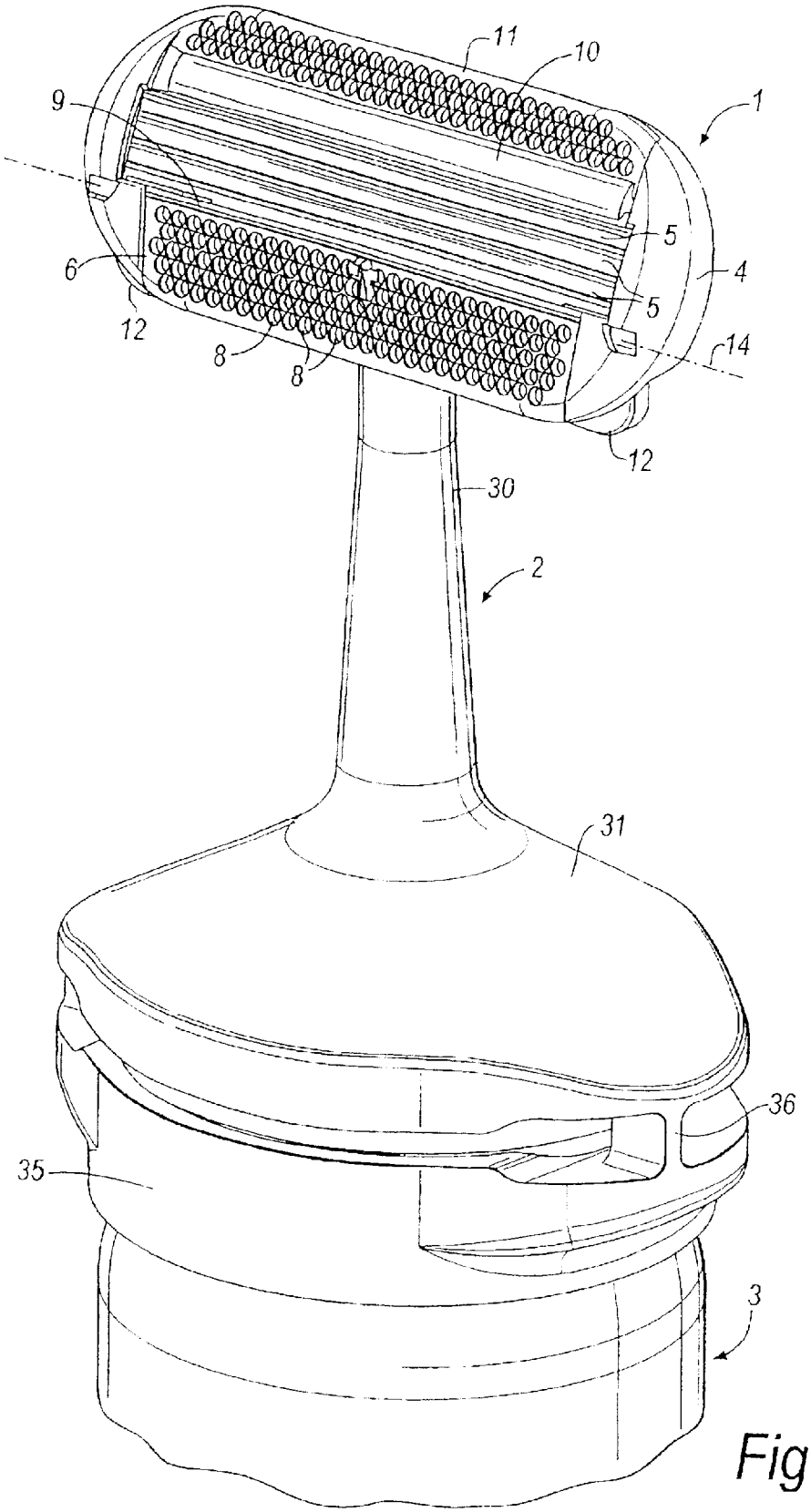
FIG. 2 is an enlarged isometric view showing the blade unit of the razor and its carrying structure.
Figure 3:
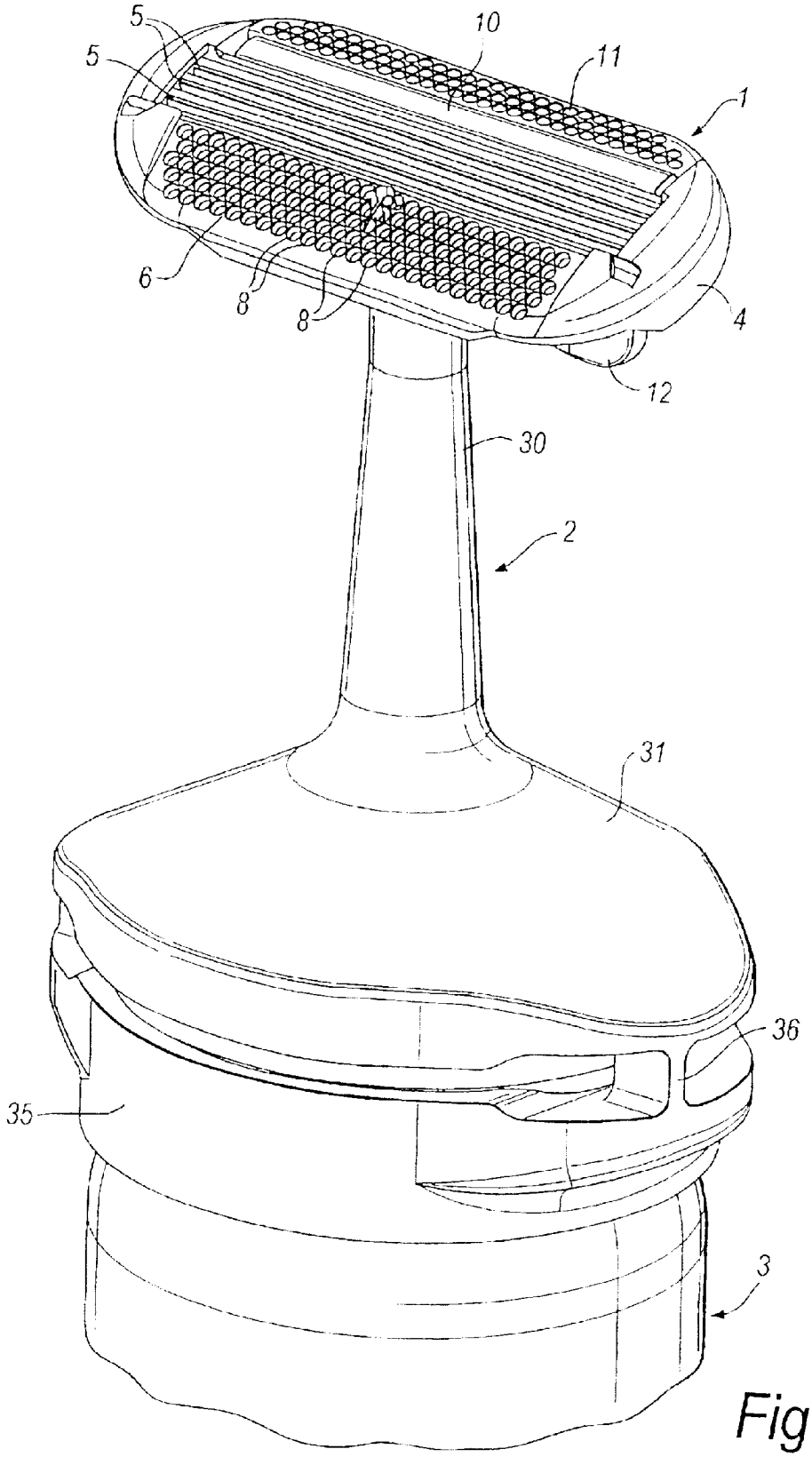
FIG. 3 is a view similar to FIG. 2, but showing the blade unit in a different pivotal position on the carrying structure.

The razor illustrated in FIGS. 1 to 5 of the drawings includes a blade unit 1 detachably and pivotally mounted on a blade unit carrying structure 2 which is attached to a container 3. The blade unit 1 may take any desirable form, but as shown it comprises a plastic frame 4 defining an opening in which three blades 5 are mounted, preferably for movement independently of each other against the action of springs which act on the undersides of the blades, or more particularly on the supports on which the blades are respectively mounted. In front of the sharpened edges of the blades 5 which are substantially parallel to each other is a guard surface 6 defined by an element of elastomeric material having a close-packed array of pockets 8 open at the skin contacting surface of the guard. Between the guard surface defined by the element of elastomeric material and the blades is a so-called backstop 9 integral with the blade unit frame 4. Carried by the frame 4 behind the blades are cap members comprising a lubricating strip 10 which may be of a form known in the art, and an elastomeric element 11 similar to that defining the guard surface 6 but narrower and having three rows of pockets 8 rather than five rows.

The blade unit 1 is pivotally mounted on a pair of yoke arms 12 which project from the blade unit carrying structure 2 and terminate in respective journals which are held within sockets provided at the opposite ends of the blade unit frame 4 so that the blade unit is able to pivot about a predetermined axis 14 located beneath the guard surface 6 adjacent the backstop 9. The mounting of the blade unit 1 to the yoke arms 12 may be as described in greater detail in our patent application No. WO 97/37819, or as described in our application No. WO 93/10947, the contents of which are incorporated herein by way of this reference. Suitable materials for the lubricating strip 10 and the elastomeric elements of the guard and/or cap are those mentioned in U.S. Pat. Nos. 5,113,585 and 5,249,361, the contents of which specifications are also incorporated herein by reference.

Figure 4:
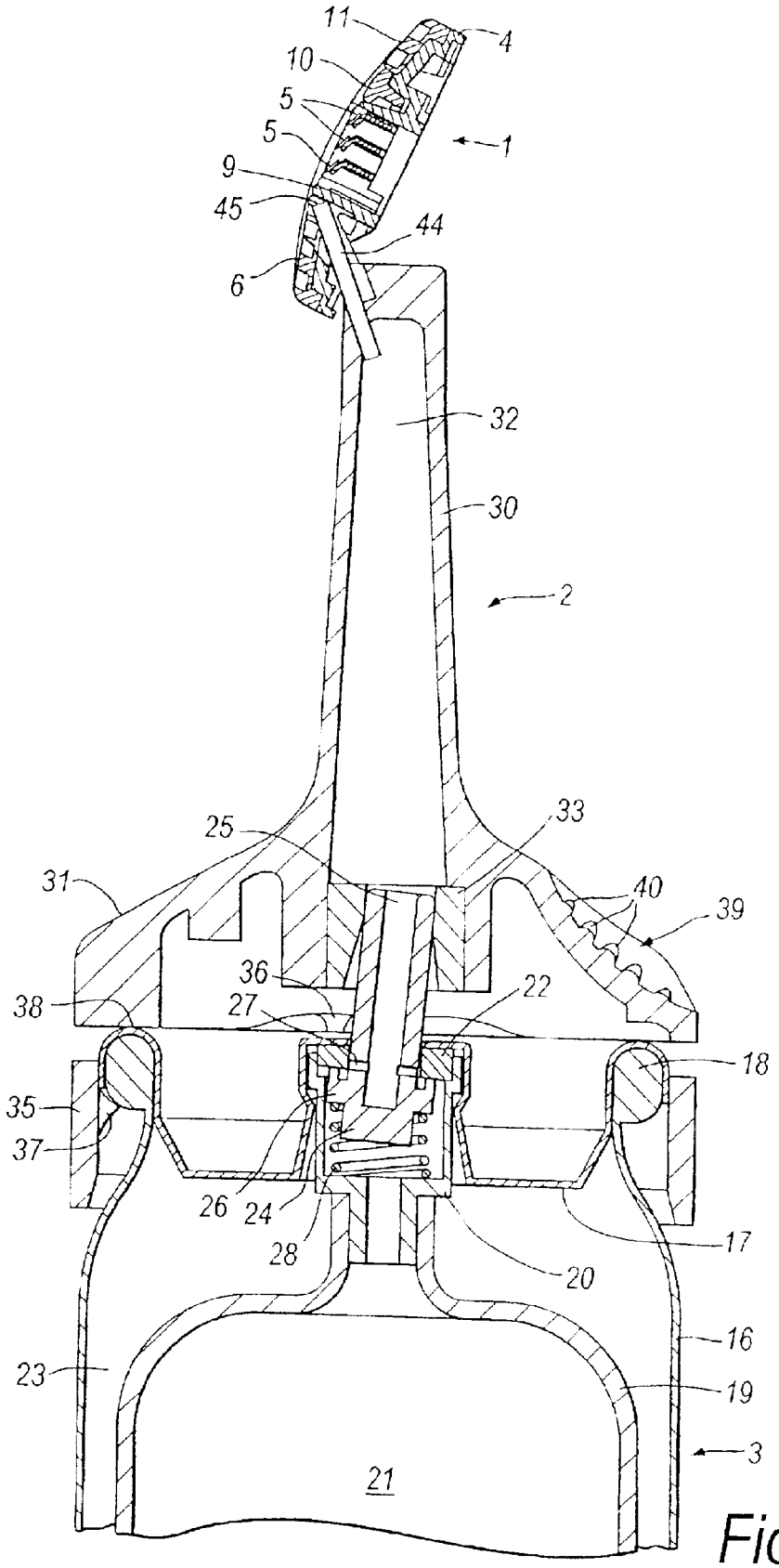
FIGS. 4 and 5 are enlarged axial cross-sections through the upper parts of the razor as shown in FIGS. 2 and 3 and respectively showing the valve closed and open.
Figure 5:
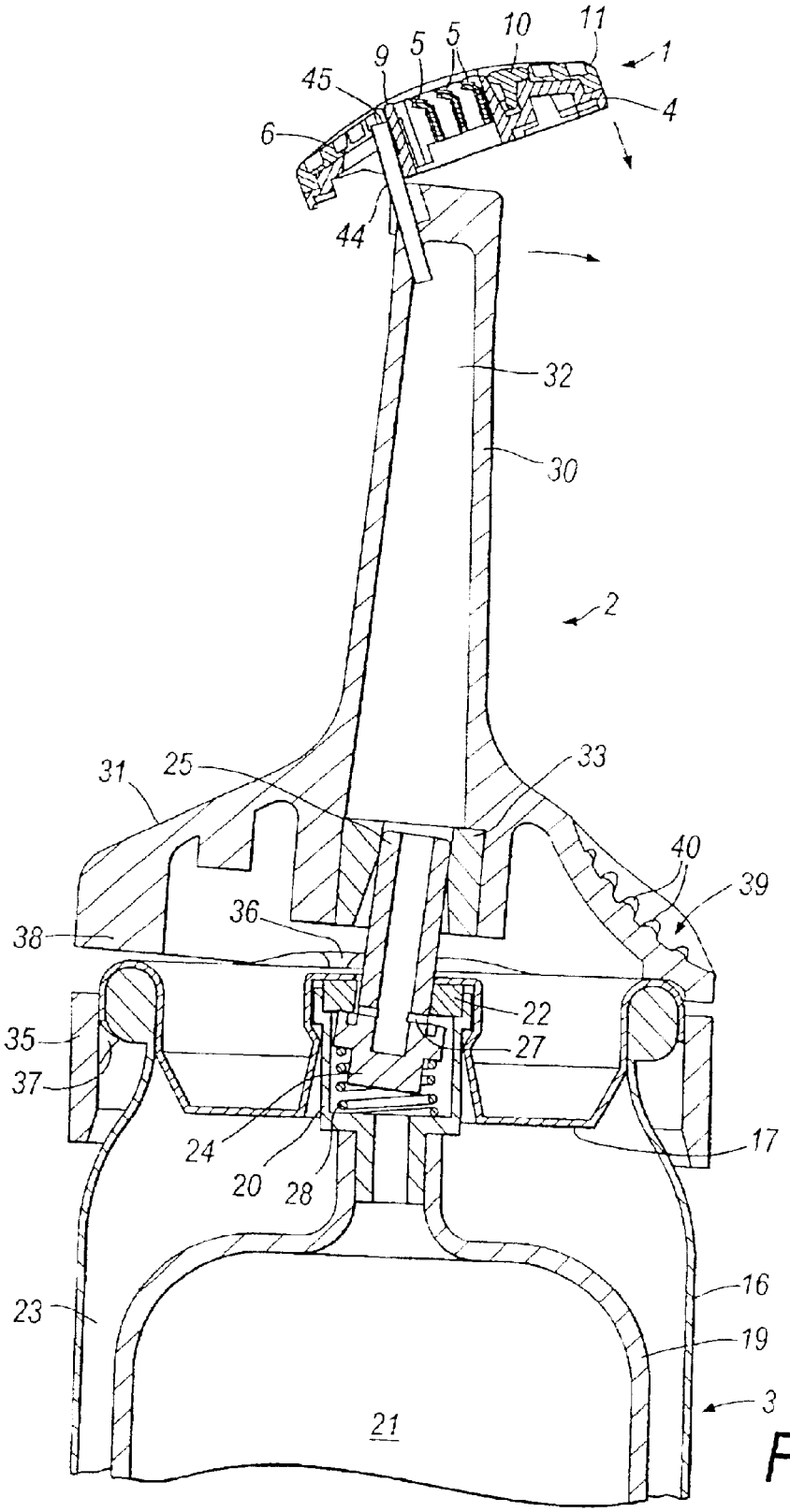
Figure 6:
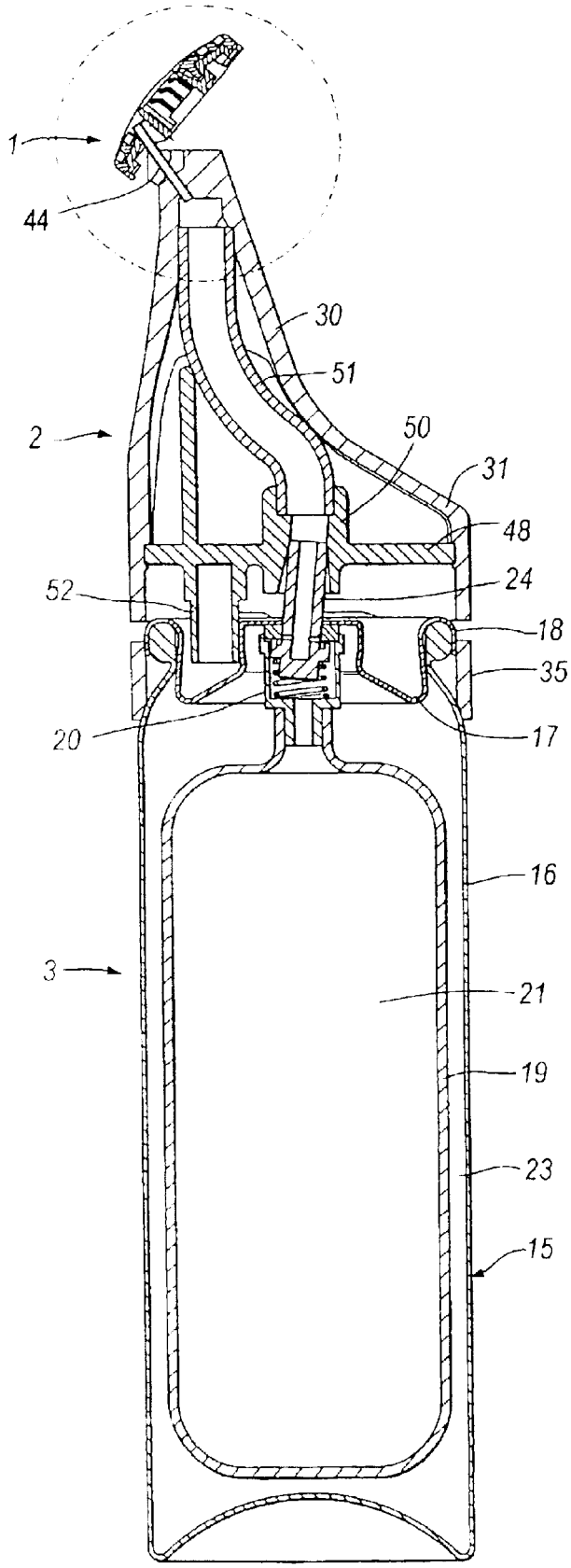
FIG. 6 is an axial cross section through another embodiment of a razor in accordance with the invention.

The container 3 is shown to include an outer rigid canister 15 with a main body 16 and a top wall 17 joined to the body 16 at a rim 18. Within the canister 15 is a fluid reservoir 21 formed within bag 19 having a flexible wall which is able to collapse as the contents of the bag are discharged. A neck at the upper end of the bag 19 is sealed to a valve housing 20 and the upper end of the valve housing is held by a shaped central section of the canister top wall 17, a resiliently compressible annular valve seat 22 (FIGS. 4 and 5) being held between the top wall 17 and the valve housing 20. The closed space 23 confined between the canister 15 and the bag 19 contains a propellant gas for forcing the bag to collapse and discharge its contents when the valve is opened, in a manner well known in the art of aerosol containers. A valve member 24 with a blind bore 25 has its closed end disposed within the valve housing 20 and a peripheral flange 26 on the valve member is normally biased into sealing engagement with the valve seat 22 by a spring 28. One or more orifices 27 communicate the bore 25 with the exterior of the valve member 24 immediately above the flange 26 and provide a path through which the container contents can escape when the flange 26 is displaced to interrupt its sealing engagement with the valve seat 22, as depicted in FIG. 5.

The blade unit carrying structure 2 comprises a hollow shaft or stem 30 extending upwardly from a flange-like base 31 with a generally frustoconical upper surface. The central bore 32 of the hollow stem 30 opens through the base and is provided with an eccentric counterbore in which an annular seal 33 is received. The tubular upper end of the valve member 24 is inserted into the seal 33 and makes sealing contact therewith. Due to the eccentric positioning of the seal 33 the valve member is constrained to adopt the slightly canted position shown in FIG. 4. It will be clear that when the valve is opened, as shown in FIG. 5 and described below, the contents of the reservoir 21 in the container are delivered into the bore 32.

The base 31 is integrally connected to a supporting structure in the form of a ring 35 which is securely attached to the container, for example by a close friction fit with the container ring 18, or by a snap-fit engagement provided by a plurality of projections 37 spaced around the inside circumference of the ring 35. The base 31 and the supporting ring 35 are interconnected by a pair of webs 36 which constitute living hinges and define an axis about which the blade unit carrying structure 2 can pivot relative to the container 3. The webs 36 are approximately diametrically opposed although in the illustrated embodiment they are disposed a short distance forwardly of the central axis of the container 3 and the blade unit carrying structure 2. A stop 38 is provided on the underside of the base at a forward most circumferential location this stop is arranged to abut the container rim 18 when the valve is closed, as shown in FIGS. 4 and 5. At a rearmost circumferential position diametrically opposite the stop 38, the upper surface of the base is shaped with a shallow depression 39 to define a finger button at which ribs 40 or other surface configurations are provided to improve frictional engagement with the finger. With the container 3 held in the hand the forefinger of the same hand can be used to engage and depress the finger button 39 thereby to cause the blade unit carrying structure 2 to pivot at the flexible hinges 36 which in turn tilts the valve member 24 in a clockwise direction as viewed in the drawings so that the sealing engagement between the flange 26 of the valve member and the valve seat 22 is interrupted and the pressurised contents of the reservoir in the container flow out via the orifice 27 and bore 25 into the bore 32 of the stem 30 of the blade unit carrying structure for delivery to the blade unit 1 (see FIG. 5). This is one method by which the valve may be selectively actuated by the user of the razor. According to an important aspect of the invention, however, the valve is arranged to be actuable automatically in the process of shaving. The laterally opposed yoke arms 12 are oriented to support the blade unit 1 with its longitudinal axis substantially parallel to the pivot axis defined by the hinge webs 36, and with the operative face of the blade unit directed forwardly i.e. generally away from the finger button 39 which is located at the rear. By this arrangement with the razor being held by means of the container 3 which forms the handle of the razor, the blade unit 1 can be pressed against the skin in the course of performing a shaving stroke so that a torque is generated to cause the blade unit carrying structure 2 to move by hinging at the webs 36 thereby opening the valve as described above in connection with the manual actuation. When the blade unit is lifted from the skin, the blade unit carrying structure 2 returns to its normal position as illustrated in FIG. 4 under the combined effects of the inherent resilience in the hinge webs 36 and the force of the spring 28 which strives to displace the valve member 24 to the closed position. Of course, an additional mechanical return spring could be included to ensure return movement of the blade unit carrying structure and hence reliable closing of the valve. Because the valve is opened automatically in the process of shaving, the fluid can be dispensed in controlled metered quantities without relying on judgement or dexterity of the user.

The return force provided by the resilient webs, etc may be selected so that the valve is opened by pressing the blade unit 1 against the skin under forces typically applied during shaving, or it can be made stronger so that a user must consciously press the blade unit against the skin with greater than usual force to open the valve and dispense the fluid. In the latter case the razor is adapted to provide selective dispensing of fluid under control of the user.

From the upper end of the bore 32 in the stem 30 of the blade unit carrying structure, the fluid is conducted to the blade unit 1 by a delivery tube 44 which is fixed relative to the stem 30 and at its distal end defines a discharge port 45 located substantially on the axis 14 about which the blade unit is pivotally mounted on the yoke arms 12. It will be seen that the discharge port 45 is disposed at a small distance on the underside of the guard surface 6 adjacent the backstop 9. The fluid delivered through the discharge port passes through a hole in the elastomeric guard element 6 conveniently formed by one or more of the pockets 8, so that it is supplied directly to the skin which is sliding over the guard surface during shaving. There is no direct mechanical connection between the delivery tube 44 and the blade unit so that the delivery tube does not interfere with pivotal movements of the blade unit, e.g. between the positions illustrated in FIGS. 2 and 3, to follow the skin contours during shaving. In a manner known per se a spring arrangement can be provided to bias the blade unit to a predetermined pivotal position such as the FIG. 2 position. As a result of the discharge port 45 being located at or very close to the pivot axis 14 reliable delivery of fluid to the desired location on the blade is ensured while the pivoting capability is not impaired in any respect.

The described razor can be used for applying directly to the skin during shaving any desirable fluid. The fluid may for example exhibit any one or more of the qualities or properties of the following fluids:

(i) shaving soap;
(ii) lubricant;
(iii) skin conditioner;
(iv) skin moisturiser
(v) hair softener or conditioner to facilitate cutting;
(vi) fragrance;
(vii) skin cleanser;
(viii) bacterial or medicinal lotion; and
(ix) blood coagulant or the like for beneficial treatment of minor cuts and abrasions which can be suffered during shaving.

FIGS. 6 to 10 illustrate a modified razor the construction of which for the most part is similar to the razor of FIGS. 1 to 5 and, therefore, only the main differences will be described and the same reference numerals have been used in the drawings to denote corresponding parts of the respective razors.

The hollow stem 30 of the blade unit carrying structure 2 is disposed eccentrically of the base 31 so as to position the blade unit 1 more forwardly than in the razor of FIG. 1, which can in some circumstances facilitate use of the razor. Fitted within an outer part of the blade unit carrying structure which includes the hollow stem 30 and the base 31 and which supports the delivery tube 44, is an inner part having a plate 48 with a tubular boss 50 with which the valve member 24 cooperates, a connection tube 51 being inserted between the inner end of the boss 50 and the upper end of the stem 30 for conducting fluid discharged from the container 3 to the delivery tube 44. In this embodiment the valve and its operation are exactly as described above in connection with the first embodiment. Thus, when the blade unit 1 is pressed against the skin with sufficient force in the course of shaving, the blade unit carrying structure 2 pivots about the hinge connection formed by the webs interconnecting the base 31 and the supporting ring 35, whereby the valve member 24 is tilted to open the passage enabling the pressurised fluid to pass out of the container 3 and to the delivery tube 44 via the connection tube 51. The pivoting of the blade unit carrying structure 2 is in this embodiment limited by a stop member 52 which extends downwardly from the plate 48 into the annular recess defined in the top wall 17 of the container between the outer rim 18 and the central section enclosing the valve housing 20, the pivotal displacement being limited by abutment between this stop member 52 and the rim and the central section, respectively.

Figure 7:
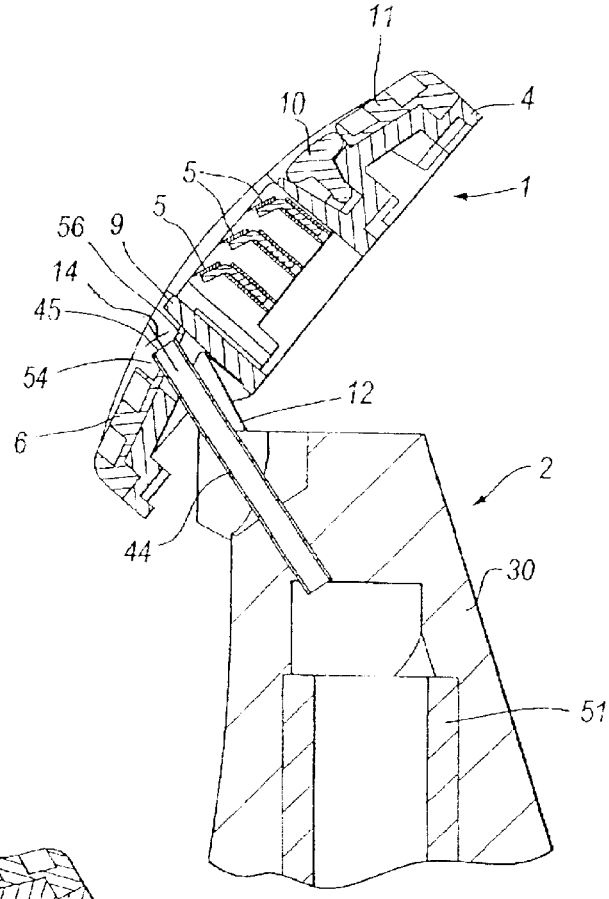
FIG. 7 shows on a larger scale the part of the razor shown circled in FIG. 6.
Figure 8:
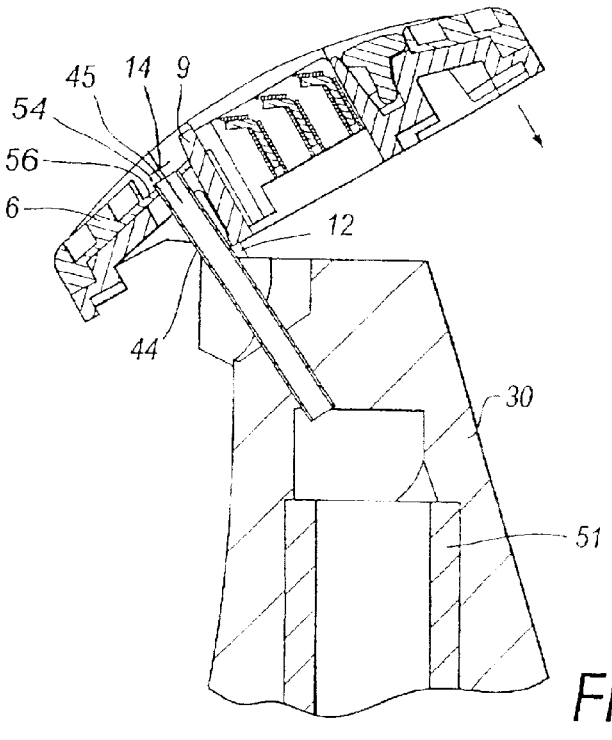
FIG. 8 is a view corresponding to FIG. 7 but showing the blade unit pivoted to a position of maximum pivotal displacement.
Figure 9:
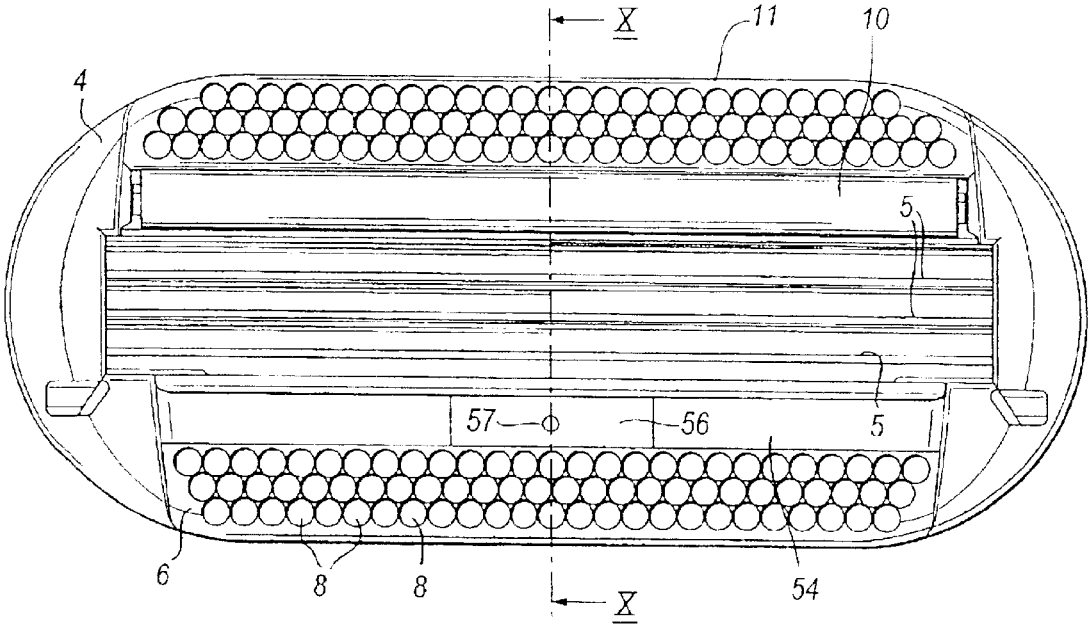
FIG. 9 shows the blade unit of FIGS. 6–8 in plan view.
Figure 10:
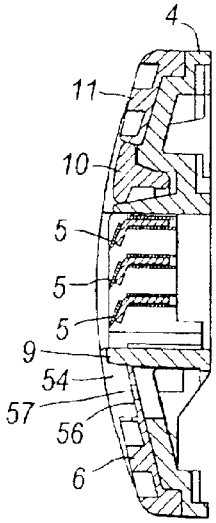
FIG. 10 is a transverse cross section through the blade unit.

The blade unit 1 in the embodiment of FIGS. 6–10 is mounted on the carrying structure 2 by yoke arms 12 as described above, so that the blade unit is able to pivot between the positions respectively shown in FIGS. 7 and 8, about an axis 14 located in close proximity to the port 45 defined at the discharge end of the delivery tube 44. The elastomeric element 6 defining the guard surface of the blade unit includes a rear portion arranged with the backstop 9 to define a channel 54 extending across the blade unit for the full length of the element 6 and the backstop, the top of the channel being open continuously over the length of the channel. The discharge port 45 opens into the channel 54, as shown clearly in FIGS. 7 and 8, and the channel 54 serves to distribute the fluid across the blade unit 1 in the direction of the pivot axis 14. During shaving, the skin segment which is contacted by the elastomeric guard element 6 and the backstop 9 tends to close off the channel opening to encourage fluid to pass along the channel from the discharge port 45. This closing of the channel opening can also lead to a build up of fluid pressure in the channel and to prevent fluid being forced by this pressure to the underside of the blade unit, the elastomeric material of the element 6 forms a lip 56 with a hole 57 through which the delivery tube passes so that the lip 56 surrounds and seals against the delivery tube 44. The elastomeric lip is sufficiently flexible that it does not significantly oppose the pivotal movement of the blade unit 1 on the supporting yoke arms 12, the displacement of the delivery tube at the lip seal being only small in any event due to the end of the delivery tube being at or very close to the pivot axis 14.

Other details of the construction and operation of the razor illustrated in FIGS. 6–10 will be understood from the foregoing description of the razor shown in FIGS. 1–5.

Modifications are of course possible to the specific embodiment described above without departing from the scope of the invention as defined by the claims which follow. The blade unit may be permanently mounted on the blade unit carrying structure so that the entire assembly of the blade unit and its carrying structure will be discarded when the blades have become dulled. Alternatively the blade unit 1 may be detachable from the carrying structure with the intention that the blade unit 1 be replaced on the carrying structure when the blades have become blunted. For this purpose the yoke arms may be adapted to disengage the blade unit, or the yoke arms could be included with the blade unit and have a releasable connection with the stem of the blade unit carrying structure. Also the particular form of the blade unit is unimportant to the inventive concept and other forms of blade unit besides those described in detail can be used. If desired a mechanism could be included to control selectively the maximum fluid discharge rate, for example by adjusting a stop which limits the pivoting of the blade unit carrying structure and hence the degree to which the valve can be opened to allow the pressurised fluid to be discharged from the container.

What is claimed is:

1. A razor comprising a blade unit carrying structure on which a blade unit is permanently or detachably mounted for pivotal movement relative to the blade unit carrying structure about a predetermined pivot axis extending longitudinally through the blade unit, and a delivery system for conducting a fluid dispensed from a reservoir connected to the blade unit carrying structure to at least one discharge port, wherein the discharge port has an opening located at or close to the predetermined pivot axis of the blade unit for discharging the fluid through said opening directly to the skin at or near the predetermined pivot axis, and the discharge port is defined by a tubular member extending through said blade unit and terminating at a position at or adjacent to the pivot axis of the blade unit.

2. A razor according to claim 1, wherein the blade unit includes an elastomeric element surrounding and sealing against the tubular member adjacent the discharge port.

3. A razor according to claim 1, wherein the discharge port opening is defined by the tubular member which remains stationary with respect to the blade unit carrying structure during pivotal movement of the blade unit about the predetermined axis.

4. A razor according to claim 3, wherein the tubular member is not mechanically coupled directly to the blade unit.

5. A razor according to claim 1, wherein the blade unit includes a channel for distributing fluid delivered through the discharge port across the blade unit in the direction of the pivot axis.

6. A razor according to claim 5, wherein the channel extends substantially parallel to the pivot axis.

7. A razor according to claim 6, wherein the channel is open continuously along the length thereof to allow fluid to pass out of the channel.

8. A razor according to claim 1, wherein the blade unit carrying structure is movably connected to a supporting structure and is movable relative to the supporting structure for actuating a valve included in the delivery system to control flow of fluid to the discharge port.

9. A razor according to claim 8, wherein the blade unit carrying structure is hingedly coupled to the supporting structure for the valve to be actuated by movement of the blade unit carrying structure caused by pressing the blade unit against the skin during shaving.

10. A razor according to claim 8, wherein the blade unit carrying structure comprises a hollow stem structure extending from a flanged base, the base being engagable by a finger of a hand in which the razor is held for selectively displacing the blade unit carrying structure to actuate the valve.

11. A razor according to claim 8, wherein the reservoir is formed by a container having a rim surrounding the valve, and the supporting structure is firmly attached to the container at the rim thereof.

12. A razor according to claim 11, wherein the supporting structure has a friction or snap-fit engagement with the container rim.

13. A razor according to claim 11, wherein the valve includes a valve member protruding beyond the container rim and into an inlet aperture formed by the blade unit carrying structure.

14. A razor according to claim 13, wherein the inlet aperture is defined by an annular sealing member.

15. A razor according to claim 14, wherein the valve member cooperates with an annular valve seat and is capable of tilting to open the valve.

16. A razor comprising a blade unit carrying structure on which a blade unit is permanently or detachably mounted for pivotal movement relative to the blade unit carrying structure about a predetermined pivot axis extending longitudinally through the blade unit, and a delivery system for conducting a fluid dispensed from a reservoir connected to the blade unit carrying structure to at least one discharge port, wherein the discharge port has an opening located at or close to the predetermined pivot axis for discharging the fluid to the blade unit at a guard surface at or near the predetermined pivot axis, and wherein the discharge port is defined by a tubular member, and the blade unit includes an elastomeric skin contacting element having a lip surrounding and sealing against the tubular member adjacent the discharge port.

17. A razor comprising a blade unit carrying structure on which a blade unit is permanently or detachably mounted for pivotal movement relative to the blade unit carrying structure about a predetermined pivot axis extending longitudinally through the blade unit, and a delivery system for conducting a fluid dispensed from a reservoir connected to the blade unit carrying structure to at least one discharge port, wherein the discharge port has an opening located at or close to the predetermined pivot axis for discharging the fluid at or near the predetermined pivot axis, and wherein the discharge port is defined by a tubular member, and the blade unit includes an elastomeric element surrounding and sealing against the tubular member adjacent the discharge port.

18. A razor blade unit carrying structure on one end of which a blade unit is permanently or detachably mounted for pivotal movement relative to the carrying structure about a predetermined pivot axis extending longitudinally through the blade unit, the carrying structure including a delivery duct for conducting a fluid supplied from a reservoir to the blade unit, an opposite end of the carrying structure being hingedly coupled to a supporting structure for a valve which is operable to control supply of fluid to the delivery duct from the reservoir to be actuated by displacement of the blade unit carrying structure relative to the supporting structure at the hinge coupling therebetween caused by pressing the blade unit against the skin during shaving, and wherein the blade unit carrying structure and the supporting structure are integrally connected by at least one flexible web which defines a second pivot axis about which the blade carrying structure is pivotable relative to the supporting structure.

19. A razor according to claim 18, wherein the blade unit is supported by the blade unit carrying structure with its longitudinal axis substantially parallel to the second pivot axis defined by the web.

20. A razor comprising a blade unit carrying structure on one end of which a blade unit is permanently or detachably mounted for pivotal movement relative to the carrying structure about a predetermined pivot axis extending longitudinally through the blade unit, an opposite end of the blade unit carrying structure being hingedly connected to a supporting structure, a delivery system for conducting a fluid to the blade unit from a reservoir, the delivery system including a valve for controlling supply of fluid to the blade unit, the blade unit carrying structure being coupled to the valve for the valve to be actuated by displacement of the blade unit carrying structure relative to the supporting structure caused by pressing the blade unit against the skin during shaving, and the blade unit carrying structure being resiliently biased to close the valve when the blade unit is lifted clear of the skin, and wherein the blade unit carrying structure and the supporting structure are integrally connected by at least one flexible web which defines a second pivot axis about which the blade carrying structure is pivotable relative to the supporting structure.

21. A razor according to claim 20, wherein the blade unit is supported by the blade unit carrying structure with its longitudinal axis substantially parallel to the second pivot axis defined by the web.

22. A razor according to claim 20, wherein the blade unit carrying structure and the supporting structure are integrally connected.

23. A razor as defined in claim 22, wherein the supporting structure comprises a ring to which the blade unit carrying structure is integrally connected by a pair of laterally opposed webs.

24. A razor according to claim 23, wherein the blade unit carrying structure has a stop for abutment with the container rim to define an end position from which the blade unit carrying structure is pivotable to actuate the valve.

* * * * *